US012385503B1

(12) United States Patent
Hsu et al.

(10) Patent No.: US 12,385,503 B1
(45) Date of Patent: Aug. 12, 2025

(54) AXIAL FAN AND AXIAL FAN ASSEMBLY

(71) Applicant: Delta Electronics, Inc., Taoyuan (TW)

(72) Inventors: Kuo-Tung Hsu, Taoyuan (TW); Wen-Chun Hsu, Taoyuan (TW); Chao-Fu Yang, Taoyuan (TW); Wei-Cheng Liao, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 19/052,949

(22) Filed: Feb. 13, 2025

(30) Foreign Application Priority Data

Aug. 27, 2024 (CN) ..... 202422077874.9

(51) Int. Cl.

| | |
|---|---|
| ***F04D 19/00*** | (2006.01) |
| ***F04D 29/32*** | (2006.01) |
| ***F04D 29/54*** | (2006.01) |
| ***F04D 29/66*** | (2006.01) |

(52) U.S. Cl.
CPC ..... *F04D 29/667* (2013.01); *F04D 19/002* (2013.01); *F04D 29/325* (2013.01); *F04D 29/541* (2013.01)

(58) Field of Classification Search
CPC .... F04D 29/667; F04D 19/002; F04D 29/325; F04D 29/541; F04D 29/646; F04D 29/547; F04D 29/526; H05K 7/20172
See application file for complete search history.

(56) References Cited

U.S. PATENT DOCUMENTS

| | | | | |
|---|---|---|---|---|
| 6,572,333 | B2 * | 6/2003 | Fujinaka | F04D 25/0613 415/222 |
| 7,080,970 | B2 * | 7/2006 | Horng | F04D 29/545 415/213.1 |
| 7,351,032 | B2 * | 4/2008 | Horng | F04D 29/547 415/223 |
| 8,740,562 | B2 * | 6/2014 | Takemoto | F04D 29/541 415/220 |
| 2005/0042084 | A1 * | 2/2005 | Horng | F04D 29/544 415/208.1 |

(Continued)

FOREIGN PATENT DOCUMENTS

| | | |
|---|---|---|
| CN | 2426532 Y | 4/2001 |
| CN | 2549230 Y | 5/2003 |
| CN | 3421939 | 1/2005 |

(Continued)

*Primary Examiner* — Eldon T Brockman
(74) *Attorney, Agent, or Firm* — KIRTON McCONKIE; Evan R. Witt

(57) ABSTRACT

An axial fan assembly includes a first axial fan and a second axial fan arranged side by side. The second axial fan includes an impeller having a shaft, and a frame. The frame includes a surrounding wall and a lateral guiding structure. The surrounding wall forms an axial flow channel for accommodating the impeller, wherein the surrounding wall includes a first outer wall surface facing the first axial fan, and an airflow generated by the impeller flows out of the axial flow channel through an outlet end. The lateral guiding structure is protrudently disposed at the outlet end on an edge surface connected with the first outer wall surface, wherein the lateral guiding structure guides a partial airflow of the airflow at the first edge surface toward a first direction, and the first direction and a normal direction of the first outer wall surface include a first acute angle.

19 Claims, 8 Drawing Sheets

(56) References Cited

U.S. PATENT DOCUMENTS

| | | | | |
|---|---|---|---|---|
| 2005/0089402 | A1* | 4/2005 | Horng | F04D 25/0613<br>415/186 |
| 2008/0030952 | A1* | 2/2008 | Chen | H01L 23/467<br>257/E23.099 |

FOREIGN PATENT DOCUMENTS

| | | | |
|---|---|---|---|
| CN | 101842600 | B | 8/2012 |
| CN | 107023499 | B | 4/2020 |
| CN | 217783835 | U | 11/2022 |
| CN | 308193183 | S | 8/2023 |
| JP | D1680570 | S | 3/2021 |
| TW | 200809472 | A | 2/2008 |

* cited by examiner

AXIAL FAN AND AXIAL FAN ASSEMBLY

CROSS-REFERENCE TO RELATED APPLICATION

This application claims priority to China Patent Application No. 202422077874.9, filed on Aug. 27, 2024. The entire contents of the above-mentioned patent application are incorporated herein by reference for all purposes.

FIELD OF THE INVENTION

The present disclosure relates to an axial fan and an axial fan assembly, and more particularly to an axial fan and an axial fan assembly which are capable of changing the airflow direction and reducing the noises.

BACKGROUND OF THE INVENTION

As the performance of electronic devices continues to improve, heat dissipation devices have become the necessary feature for today's electronic devices. Among them, axial fans are the widely used heat dissipation devices.

The outflows of axial fan can be guided toward lateral directions for achieving heat dissipation for a larger region. However, as the axial fans are used side by side, the lateral airflows therebetween may easily cause turbulences and noises, thereby affecting the performance thereof. Moreover, because the directions of lateral airflows are scattered, it is difficult to aim the lateral airflow at a particular direction as the axial fan is applied for heat dissipation in practice, which also limits the application thereof.

Therefore, there is a need of providing an axial fan and an axial fan assembly capable of improving the defects above.

SUMMARY OF THE INVENTION

An object of the present disclosure is to provide an axial fan in which a lateral guiding structure is disposed at the outlet end thereof for achieving the effect of changing the direction of lateral airflow.

Another object of the present disclosure is to provide an axial fan assembly in which lateral guiding structures are respectively disposed adjacent to adjacent outer wall surfaces of adjacent axial fans for reducing turbulences and noises therebetween, and thus improving the performance of the axial fan assembly.

In accordance with an aspect of the present disclosure, an axial fan assembly is provided. The axial fan assembly includes a first axial fan and a second axial fan arranged side by side. The second axial fan includes a first impeller having a first shaft and a first frame. The first frame includes a first surrounding wall and a first lateral guiding structure. The first surrounding wall forms a first axial flow channel for accommodating the first impeller, wherein the first surrounding wall includes a first outer wall surface facing the first axial fan, the first axial flow channel has a first outlet end, and a first airflow generated by the first impeller flows out of the first axial flow channel through the first outlet end. The first lateral guiding structure is protrudently disposed at the first outlet end on a first edge surface connected with the first outer wall surface, wherein the first lateral guiding structure is used to guide a first partial airflow of the first airflow at the first edge surface toward a first direction, and the first direction and a normal direction of the first outer wall surface include a first acute angle.

In an embodiment, the first axial fan includes a second impeller having a second shaft, and a second frame. The second frame includes a second surrounding wall and a second lateral guiding structure. The second surrounding wall forms a second axial flow channel for accommodating the second impeller, wherein the second surrounding wall includes a second outer wall surface facing the second axial fan, the second axial flow channel has a second outlet end, and a second airflow generated by the second impeller flows out of the second axial flow channel through the second outlet end. The second lateral guiding structure is protrudently disposed at the second outlet end on a second edge surface connected with the second outer wall surface, wherein the second lateral guiding structure is used to guide a second partial airflow of the second airflow at the second edge surface toward a second direction, and the second direction and a normal direction of the second outer wall surface include a second acute angle.

In an embodiment, the first direction and the second direction are substantially opposite to and staggered from each other.

In an embodiment, the first partial airflow and the second partial airflow are converged to flow toward a first converged direction.

In an embodiment, a third axial fan is further included to arrange side by side with the second axial fan at a third outer wall surface of the first surrounding wall, and the third outer wall surface faces the third axial fan. Also, a third lateral guiding structure is further included to protrudently dispose at the first outlet end on a third edge surface connected with the third outer wall surface, wherein the third lateral guiding structure is used to guide a third partial airflow of the first airflow at the third edge surface toward a third direction, and the third direction and a normal direction of the third outer wall surface include a third acute angle In an embodiment, the third axial fan includes a third impeller having a third shaft, and a third frame. The third frame includes a third surrounding wall and a fourth lateral guiding structure. The third surrounding wall forms a third axial flow channel for accommodating the third impeller, wherein the third surrounding wall includes a fourth outer wall surface facing the second axial fan, the third axial flow channel has a third outlet end, and a fourth airflow generated by the third impeller flows out of the third axial flow channel through the third outlet end. The fourth lateral guiding structure is protrudently disposed at the third outlet end on a fourth edge surface connected with the fourth outer wall surface, wherein the fourth lateral guiding structure is used to guide a fourth partial airflow of the fourth airflow at the fourth edge surface toward a fourth direction, and the fourth direction and a normal direction of the fourth outer wall surface include a fourth acute angle.

In an embodiment, the third direction and the fourth direction are substantially opposite to and staggered from each other.

In an embodiment, the third partial airflow and the fourth partial airflow are converged to flow toward a second converged direction.

In an embodiment, the first lateral guiding structure and the third lateral guiding structure are directly connected.

In an embodiment, the first lateral guiding structure and the third lateral guiding structure are connected through a first connecting structure.

In an embodiment, the second axial fan is assembled with an external system or an external device through the first connecting structure.

In an embodiment, a distance between the first axial fan and the first outer wall surface is negatively correlated with the first acute angle.

In an embodiment, the first impeller includes a plurality of blades, and the plurality of blades have wavy surfaces or flat surfaces.

In accordance with another aspect of the present disclosure, an axial fan is provided. The axial fan includes a first impeller having a first shaft and a first frame. The first frame includes a first surrounding wall and a first lateral guiding structure. The first surrounding wall forms a first axial flow channel for accommodating the first impeller, wherein the first surrounding wall includes a first outer wall surface, the first axial flow channel has a first outlet end, and a first airflow generated by the first impeller flows out of the first axial flow channel through the first outlet end. The first lateral guiding structure is protrudently disposed at the first outlet end on a first edge surface connected with the first outer wall surface, wherein the first lateral guiding structure is used to guide a first partial airflow of the first airflow at the first edge surface toward a first direction, and the first direction and a normal direction of the first outer wall surface include a first acute angle.

In an embodiment, the first frame includes a second lateral guiding structure protrudently disposed at the first outlet end on a second edge surface connected with a second outer wall surface, wherein the second lateral guiding structure is used to guide a second partial airflow of the first airflow at the second edge surface toward a second direction, the second direction and a normal direction of the second outer wall surface include a second acute angle, and the first outer wall surface and the second outer wall surface are different outer wall surfaces of the first surrounding wall.

In an embodiment, the normal direction of the first outer wall surface and the normal direction of the second outer wall surface are different.

In an embodiment, a portion of a boundary of the first outer wall surface and a portion of a boundary of the second outer wall surface are directly connected and have an included angle.

In an embodiment, a portion of a boundary of the first edge surface is directly connected with a portion of a boundary of the second edge surface.

In an embodiment, the first impeller includes a plurality of blades, and the plurality of blades have wavy surfaces or flat surfaces.

BRIEF DESCRIPTION OF THE DRAWINGS

The above contents of the present disclosure will become more readily apparent to those ordinarily skilled in the art after reviewing the following detailed description and accompanying drawings, in which.

DETAILED DESCRIPTION OF THE EMBODIMENT

The present disclosure will now be described more specifically with reference to the following embodiments. It is to be noted that the following descriptions of embodiments of this disclosure are presented herein for purpose of illustration and description only. It is not intended to be exhaustive or to be limited to the precise form disclosed.

Figure 1:
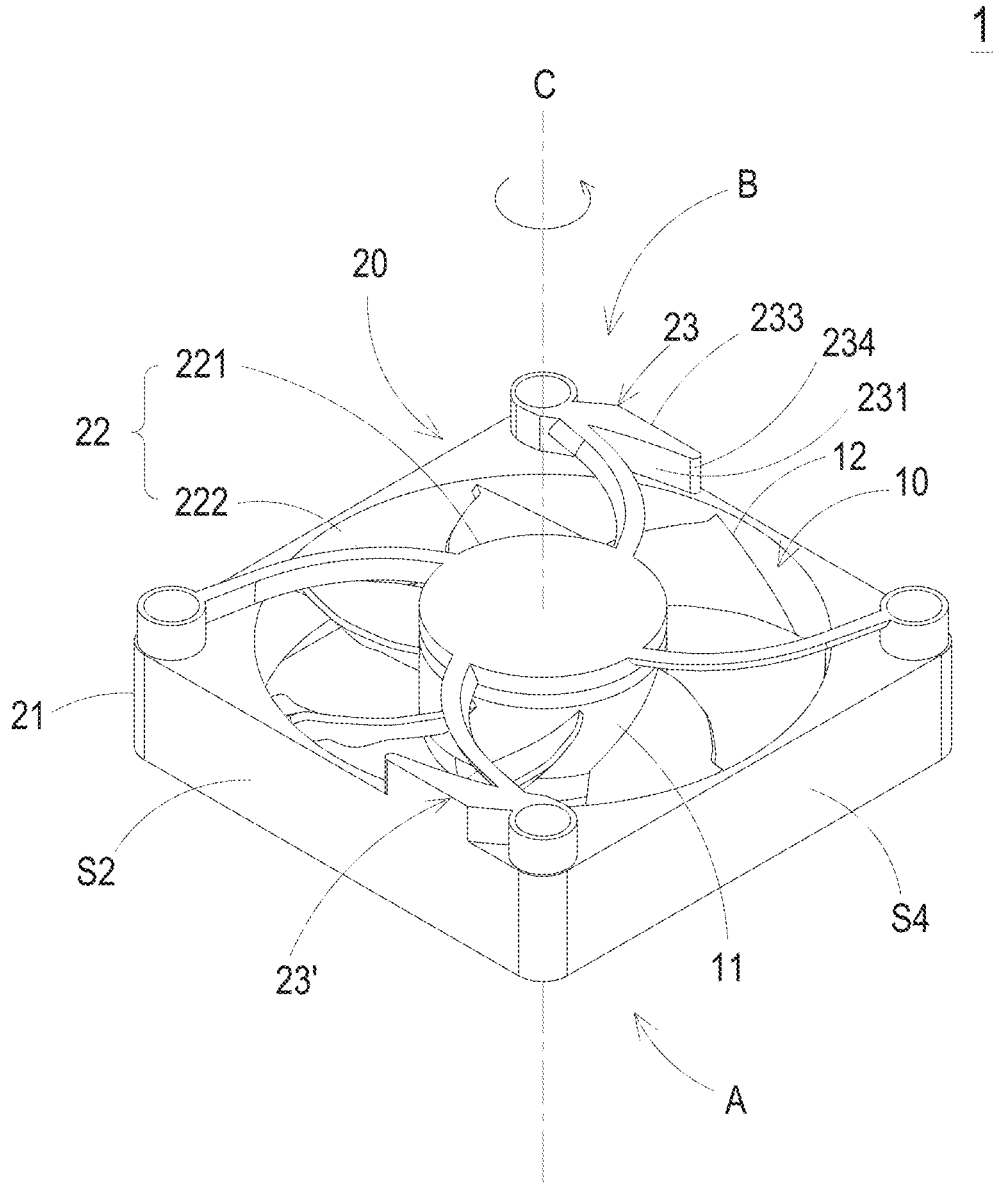
FIG. 1 is a schematic view showing an axial fan according to an embodiment of the present disclosure.
Figure 2A:
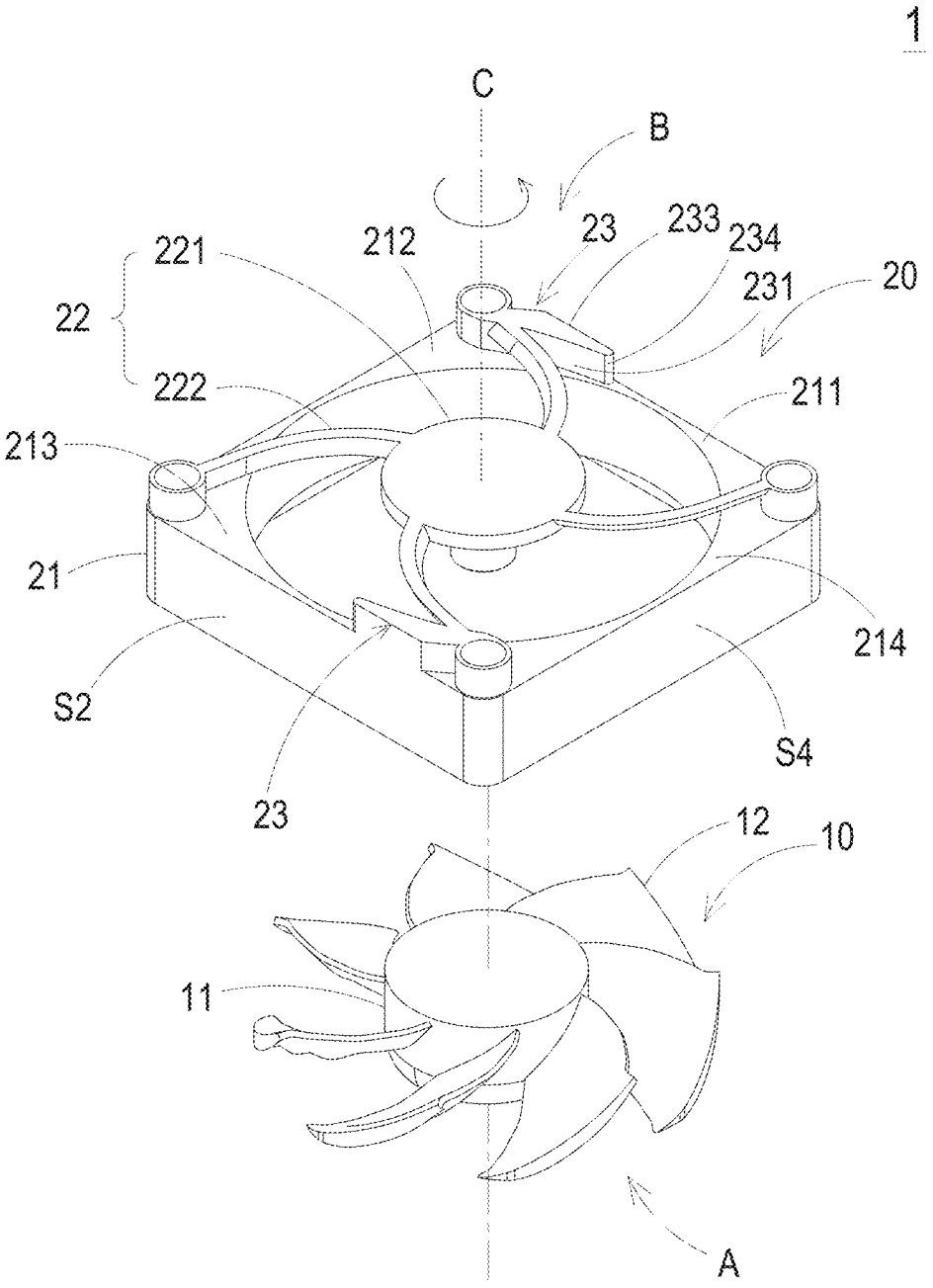
FIG. 2A is an exploded schematic view showing the axial fan according to the embodiment of the present disclosure.
Figure 2B:
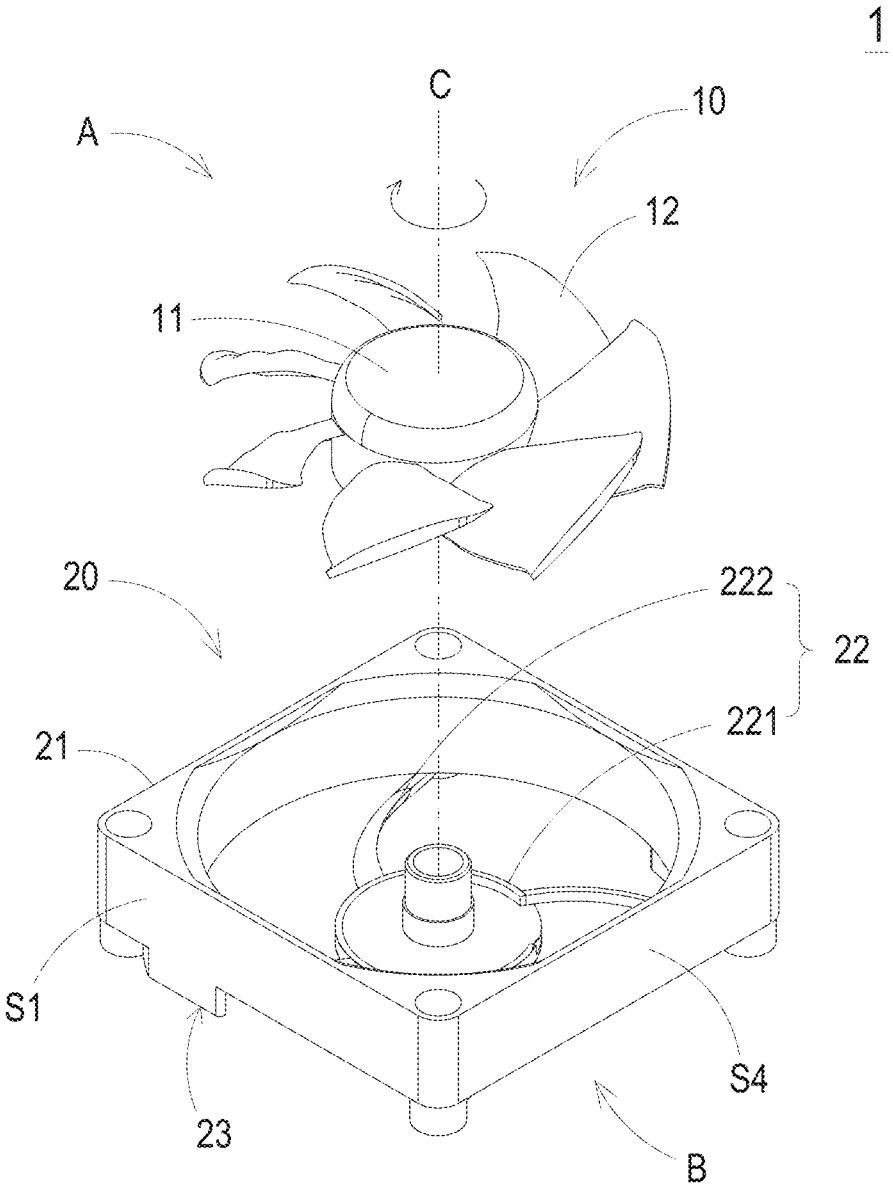
FIG. 2B is an exploded schematic view showing the axial fan according to the embodiment of the present disclosure from another view angle.
Figure 3:
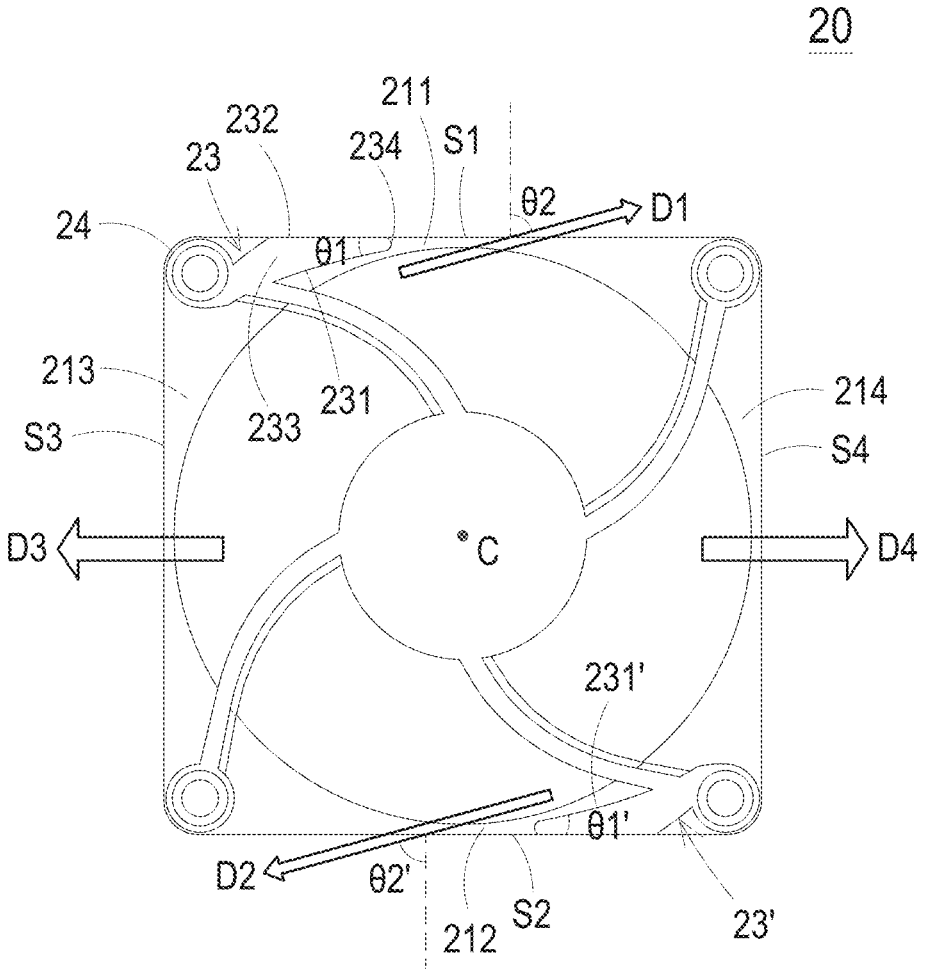
FIG. 3 is a top view showing the axial fan according to the embodiment of the present disclosure.
Figure 4:
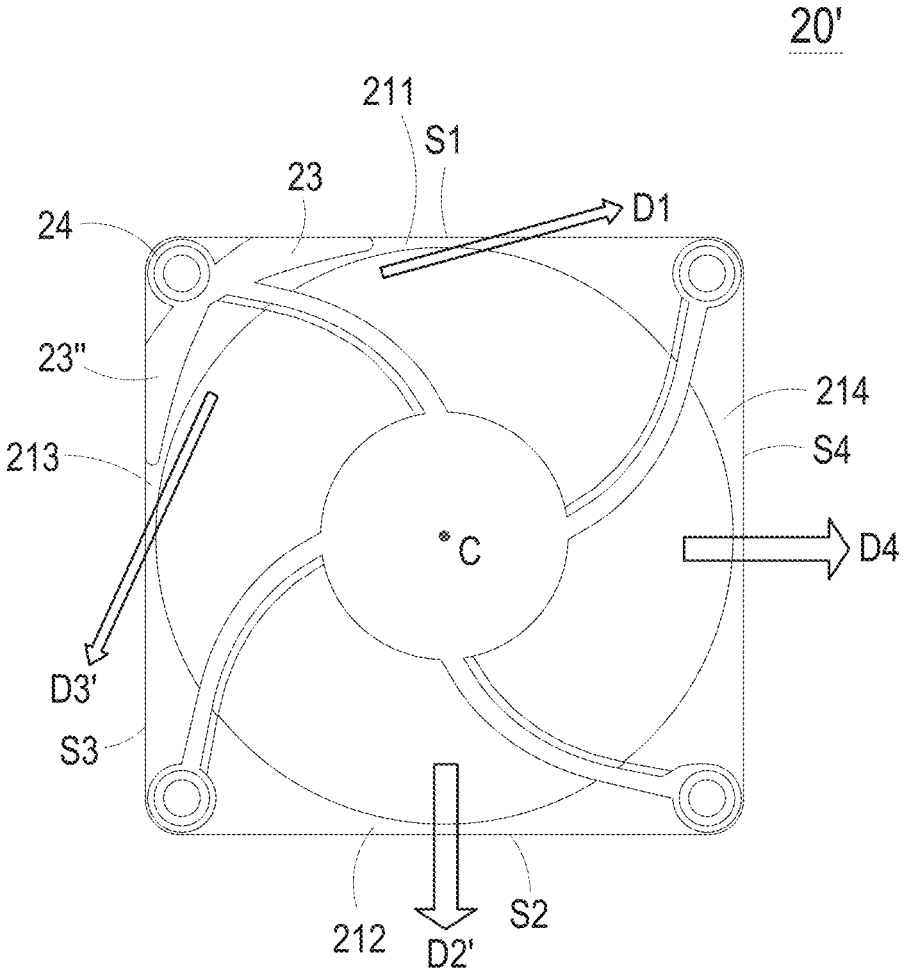
FIG. 4 is a top view showing an axial fan according to another embodiment of the present disclosure.

Please refer to FIG. 1, FIG. 2A, FIG. 2B, FIG. 3 and FIG. 4. FIG. 1 is a schematic view showing an axial fan according to an embodiment of the present disclosure, FIG. 2A is an exploded schematic view showing the axial fan according to the embodiment of the present disclosure, FIG. 2B is an exploded schematic view showing the axial fan according to the embodiment of the present disclosure from another view angle, FIG. 3 is a top view showing the axial fan according to the embodiment of the present disclosure, and FIG. 4 is a top view showing an axial fan according to another embodiment of the present disclosure. An axial fan 1 according to the present disclosure includes an impeller 10 and a frame 20, and the impeller 10 is accommodated in the frame 20. The impeller 10 includes a hub 11 and a plurality of blades 12, wherein the plurality of blades 12 are disposed on the periphery of the hub 11, and the hub 11 is rotated along a shaft C for generating airflows. In FIG. 1 and FIG. 2A, the impeller 10 is rotated counterclockwise along the shaft C, and in FIG. 2B, the impeller 10 is rotated clockwise along the shaft C. The blades 12 can be implemented to have wavy surfaces, flat surfaces or other type of surfaces in accordance with the practical requirements without limitation. The frame 20 includes a surrounding wall 21 and a base 22, and the surrounding wall 21 and the base 22 can be formed monolithically or separately. A connecting structure 24 is further disposed on the surrounding wall 21 for assembling with an external system or other external device.

The surrounding wall 21 forms an axial flow channel, such as a column shape axial flow channel, for accommodating the impeller 10, wherein the axial flow channel has an inlet end A and an outlet end B, and the airflow generated by running the impeller 10 is flowed out through the outlet end B. In this embodiment, the surrounding wall 21 is implemented to form a cuboid with rounded corners which includes four outer wall surface S1, S2, S3 and S4, wherein the normal direction of the outer wall surface S1 is 180 degrees to the normal direction of the outer wall surface S2, 90 degrees to the normal direction of the outer wall surface S3, and 270 degrees to the normal direction of the outer wall surface S4. In other embodiments, the surrounding wall 21 also can be formed to have other types of solid shapes with corresponding numbers of outer wall surfaces for forming the axial flow channel. For example, the surrounding wall 21 may form a pentagonal prism with five outer wall surfaces, and under this situation, the included angles among normal directions of outer wall surfaces are correspondingly varied. Therefore, the shape of the frame is not limited to the complying drawings.

The base 22 is used to position the impeller 10. In this embodiment, the base 22 is located at the outlet end B of the axial fan 1 and includes a center portion 221 and connecting portions 222. The center portion 221 is located at center of the area surrounded by the surrounding wall 21 for locating the impeller 10, and the connecting portions 222 connect the center portion 221 and the surrounding wall 21 in a substantially symmetrical manner. In another embodiment, the base 22 also can be located at the inlet end A of the axial fan 1. Therefore, the position of the base can be varied in accordance with the actual application situation. In this embodiment, the connecting portions 22 are implemented as four for connecting the center portion 221 to four corners of the surrounding wall 21 in cuboid shape, and each connecting portion 222 is formed to have an arc shape. However, one skilled in the art can understand that the amount, the shape and the connecting positions with the surrounding wall 21 of the connecting portions 222 can all be varied in accordance with the actual application situation, for example, the connecting portion can also be connected to a position that is not at the corner of the cuboid and/or the shape of the connecting portion can also be implemented as linear, S shape etc. without limitation.

The frame 20 further includes a lateral guiding structure 23. The lateral guiding structure 23 is protrudently formed on the outlet end B, that is, the lateral guiding structure 23 is a protrusion structure located on the surrounding wall 21 and extended toward the outflow direction of the axial fan 1. The position of lateral guiding structure 23 is relative to the outer wall surface of the surrounding wall 21. Take the cuboid formed by the surrounding wall 21 with four outer wall surfaces S1, S2, S3, S4 shown in FIG. 3 as example, the lateral guiding structure 23 can be disposed at the outlet end B on an edge surface that connects with each outer wall surface, namely, an edge surface 211 connected with the outer wall surface S1, an edge surface 212 connected with the outer wall surface S2, an edge surface 213 connected with the outer wall surface S3, and an edge surface 214 connected with the outer wall surface S4. In other words, the edge surfaces 211, 212, 213, 214 collectively form the installation surface at the outlet end B, and a portion of the boundary of one edge surface is connected with a portion of the boundary of another edge surface adjacent thereto, for example, a portion of the boundary of the edge surface 211 is connected with a portion of the boundary of the adjacent edge surface 213 and also connected with a portion of the boundary of the adjacent edge surface 214.

The amount of lateral guiding structure 23 can be single or multiple, and the position(s) thereof can be varied in accordance with the actual application situation. For example, as shown in FIG. 3, two lateral guiding structure 23 and 23' are applied to respectively dispose on opposite edge surfaces 211 and 212 and at diagonal positions, namely, the normal directions of the outer wall surfaces S1 and S2 which are adjacent to the lateral guiding structures 23 and 23' are opposite to each other. Alternatively, as shown in FIG. 4, two lateral guiding structure 23 and 23" are applied to respectively dispose on adjacent edge surfaces 211 and 213 and adjacent to each other, namely, the normal directions of the outer wall surfaces S1 and S3 which are adjacent to the lateral guiding structures 23 and 23" have a 90 degree included angle, and at least a portion of the boundary of outer wall surface S1 is directly connected with at least a portion of the boundary of outer wall surface S3. Alternatively, the lateral guiding structure also can be disposed at other position, for example, it can be implemented to locate one lateral guiding structure at the left end of the edge surface 211 and another lateral guiding structure at the upper end of the edge surface 214. More specifically, when there is more than one lateral guiding structure disposed on the frame 20, the normal directions of the outer wall surfaces adjacent to the lateral guiding structures are different from each other, that is, one outer wall surface is adjacent to only one lateral guiding structure. Moreover, when two lateral guiding structures are adjacent to each other, the connecting structure 24 can be further employed to connect therebetween (as shown in FIG. 4, lateral guiding structures 23 and 23" are connected through the connecting structure 24), or alternatively, two lateral guiding structures can be directly connected with each other (not shown), so that the dispositions thereof can be varied in accordance with the practical requirements without limitation. Followings are descriptions based on the lateral guiding structure 23 which is located at the upper left corner of the axial fan 1 as shown in FIG. 3 in conjunction with FIG. 2A and FIG. 2B, and the lateral guiding structure located at other position has similar structure relationship and the descriptions thereof are omitted.

The lateral guiding structure 23 includes a first surface 231, a second surface 232, a third surface 233 and an end portion 234. The first surface 231 substantially faces the shaft C and is substantially perpendicular to the edge surface 211, namely, the first surface 231 and the shaft C are substantially parallel to and face toward each other, and the first surface 231 and the outer wall surface S1 include an acute angle θ1. The second surface 232 is substantially perpendicular to the edge surface 211 and located at a position closer to the outer wall surface S1 than the first surface 231, and the second surface 232 intersects the first surface 231 at the end portion 234. In an embodiment, the second surface 232 is at least partially coplanar with the outer wall surface S1, but not limited thereto. The second surface 232 also can be formed to have a step difference from the outer wall surface S1. The third surface 233 intersects the first surface 231 and the second surface 232 and is opposite to the end portion 234. More specifically, the lateral guiding structure 23 is a protrusion structure located on the edge surface 211 and substantially enclosed by the first surface 231, the second surface 232 and the third surface 233, and is extended from a corner formed by the outer wall surfaces S1 and S3 along the outer wall surface S1 in a direction away from the corner. That is, the location for disposing the lateral guiding structure is the two end portions of the edge surface 211. In some embodiments, the lateral guiding structure 23 and the surrounding wall 21 are integrally formed, or the lateral guiding structure 23 and the connecting structure 24 are integrally formed, or the lateral guiding structure 23, the connecting structure 24 and the surrounding wall 21 are integrally formed. In some embodiments, the lateral guiding structure 23 and the connecting portion 222 are connected together, or the lateral guiding structure 23 and the connecting portion 222 are separate structures. Therefore, the structures can be varied in accordance with the actual application situation and still within the scope of the present disclosure.

Generally, when the axial fan is running without the lateral guiding structure, the outflow at the outlet end is separated into four partial airflows in four directions which are perpendicular to each other, namely, the partial airflows toward four directions: up, down, left and right in the view of FIG. 3. In the present disclosure, through employing the lateral guiding structure, the direction(s) of partial airflow(s) can be changed to a desired direction. In an embodiment, as shown in FIG. 3 where the lateral guiding structure 23 and the lateral guiding structure 23' are respectively disposed at the upper left corner and the lower right corner of the frame 20, the upward partial airflow originally perpendicular to the outer wall surface S1 and the downward partial airflow originally perpendicular to the outer wall surface S2 are influenced by the lateral guiding structures 23 and 23' and changed toward direction D1 and direction D2 which respectively have the included angles θ2 and θ2' with the normal directions of the outer wall surfaces S1 and S2. On the other hand, the left side and right side of the frame 20 do not have lateral guiding structure disposed thereon, namely, there is no lateral guiding structure disposed on the edge surfaces 213 and 214 which are respectively connected with the outer wall surfaces S3 and S4, so that the originally leftward and rightward partial airflows remain in the same directions, namely, directions D3 and D4 which are respectively perpendicular to the outer wall surfaces S3 and S4. Moreover, in another embodiment, as shown in FIG. 4 where the frame 20' has the lateral guiding structure 23 disposed on the edge surface 211 which is connected with the outer wall surface S1 and the lateral guiding structure 23" disposed on the edge surface 213 which is connected with the outer wall surface S3, and both the lateral guiding structure 23 and 23" are located at the upper left corner of the frame 20' and adjacent to each other, the upward partial airflow originally perpendicular to the outer wall surface S1 and the leftward partial airflow originally perpendicular to the outer wall surface S3 are influenced by the lateral guiding structures 23 and 23" and changed toward direction D1 and direction D3'. On the other hand, the right side and the lower side of the frame 20' do not have lateral guiding structure disposed thereon, namely, there is no lateral guiding structure disposed on the edge surfaces 212 and 214 which are connected with the outer wall surfaces S2 and S4, so that the originally rightward and downward partial airflows remain in the same directions, namely, directions D2' and D4 which are respectively perpendicular to the outer wall surfaces S2 and S4.

More specifically, in the present disclosure, the first surface 231 of the lateral guiding structure 23 is a windward surface for changing the outflow direction of the partial airflow that is toward the outer wall surface S1 adjacent thereto, so that the outflow direction can be changed to be substantially parallel to and away from the windward surface. In addition, through adjusting the included acute angle θ1 between the first surface 231 and the outer wall surface S1, the amount of airflow influenced by the windward surface (first surface 231) can be controlled, and the included acute angle θ2 between the final outflow direction (direction D1) and the normal direction of the outer wall surface S1 also can be decided, thereby achieving the effects of controlling and changing the outflow to a desired direction. For example, when the included angle θ1 is larger, the included angle θ2 becomes smaller, which means the two angles are negatively correlated. Accordingly, by disposing the lateral guiding structure adjacent to any outer wall surface of the axial fan, the effect of changing the direction of partial airflow toward that outer wall surface can be achieved.

For example, in some situations, the axial fan might be arranged to close to an object by one side thereof. When there is no lateral guiding structure disposed thereon, the partial airflow toward at said side will be blocked by the object and form conflicting airflows, thereby causing turbulences and noises and influencing the performance of the axial fan. On the other hand, if the lateral guiding structure is disposed adjacent to said side, for example, if the axial fan is arranged to employ the outer wall surface S1 in FIG. 3 to stay close to the object, then the partial airflow which is originally toward the object can be changed toward direction D1, so that turbulences between the object and the axial fan and noises can be reduced, and thus, the performance of the axial fan can be improved. In other situations, the axial fan might be arranged at a corner, such as between two walls. Then, the outer wall surfaces S1 and S3 of the axial fan shown in FIG. 4 can be employed to stay close to said two walls, so that the partial airflows which are originally toward the walls can be changed toward directions D1 and D3', thereby reducing turbulences between the walls and the axial fan, reducing noises and thus improving performance of the axial fan. In addition, the directions D1 and/or D3' of the partial airflows can be decided in accordance with the distance between the outer wall surface and the object/wall. For example, when the distance between the outer wall surface S1 and the object is closer, the included angle 62 between the direction D1 and the normal direction of the outer wall surface S1 should be larger, which means the two are negatively correlated, so as to reduce the conflicts between the outflow and the object. In other situations, the axial fan might need to generate an outflow toward a particular direction for heat dissipation, and the lateral guiding structure is also suitable to guide the outflow toward the desired direction. For example, the axial fan in FIG. 3 which has the lateral guiding structures disposed adjacent to the upper and lower outer wall surfaces is suitable for the need of increased outflow amount toward the left and right directions, and the axial fan in FIG. 4 which has the lateral guiding structures disposed adjacent to the upper and left outer wall surfaces is suitable for the need of increased outflow amount toward the right and lower directions.

Consequently, in the present disclosure, through the lateral guiding structure 23 protrudently disposed on the outlet end of the axial fan, the effect of changing the direction of the lateral partial airflow can be achieved by the windward surface (first surface 231), so that the axial fan can adapt to various arrangement situations, and simultaneously, turbulences and noises are reduced and the performance of the axial fan is improve d.

Figure 5A:
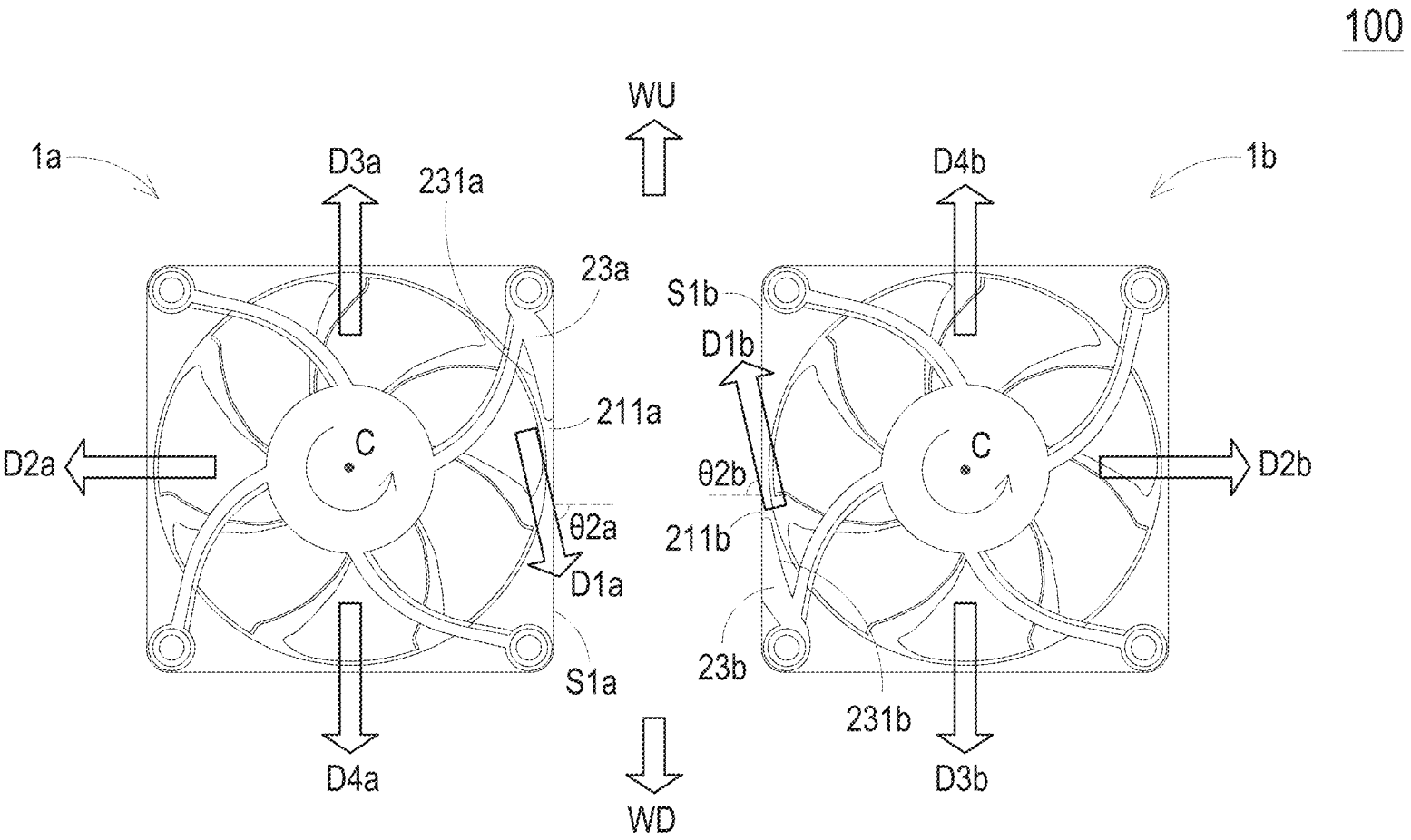
FIG. 5A is a schematic view showing an axial fan assembly according to an embodiment of the present disclosure.

Furthermore, the lateral guiding structure according to the present disclosure is also beneficial to reduce turbulences between adjacent axial fans in an axial fan assembly. Please refer to FIG. 5A which is a schematic view showing an axial fan assembly according to an embodiment of the present disclosure. In this embodiment, an axial fan assembly 100 includes an axil fan 1*a* and an axil fan 1*b* which are adjacent to each other. The axial fan 1*a* and the axial fan 1*b* face each other by employing an outer wall surface S1*a* and an outer wall surface S1*b* respectively thereof, namely, are arranged side by side as shown in FIG. 5A. A lateral guiding structure 23*a* is disposed on an edge surface 211*a* that is connected with the outer wall surface Sla, a lateral guiding structure 23*b* is disposed on an edge surface 211*b* that is connected with the outer wall surface S1*b*, and the lateral guiding structure 23*a* and the lateral guiding structure 23*b* are located at opposite ends of the adjacent outer wall surfaces S1*a* and S1*b*, that is, as shown in FIG. 5A, the lateral guiding structure 23*a* is located at the upper end related to the outer wall surface S1*a*, and the lateral guiding structure 23*b* is located at the lower end related to the outer wall surface S1*b*. Under this configuration, since both axial fans 1*a* and 1*b* are rotated counterclockwise and the lateral guiding structure 23*a* is disposed at the upper right corner of the axial fan 1*a*, the partial airflow toward the outer wall surface S1*a* will be influenced by the first surface 231*a* (the windward surface) and changed toward a lower right direction Dia. On the other hand, since the lateral guiding structure 23*b* is disposed at the lower left corner of the axial fan 1*b*, the partial airflow toward the outer wall surface S1*b* will be influenced by the first surface 231*b* (the windward surface) and changed toward a upper left direction Dib. In this way, the original outflow directions that are toward each other at the junction of the two axial fans can be changed into opposite directions. Then, it only needs to appropriately control the distance between the outer wall surface S1*a* of the axial fan 1*a* and the outer wall surface S1*b* of the axial fan 1*b* (e.g., the distance between the outer wall surfaces Sla and S1*b* is negatively correlated with the included angles θ2*a* and θ2*b*), and the guided partial airflows in directions D1*a* and D1*b* can be staggered from each other, thereby effectively reduce turbulences between axial fans, reduce noises and improve the performance of the axial fan assembly.

Furthermore, the partial airflows in other three directions (except the one toward the outer wall surface S1*a*) of the axial fan 1*a* which are not influenced by the lateral guiding structure will remain directions D2*a*, D3*a* and D4*a* that are respectively perpendicular to the outer wall surfaces. Also, the partial airflows in other three directions (except the one toward the outer wall surface S1*b*) of the axial fan 1*b* which are not influenced by the lateral guiding structure will remain directions D2*b*, D3*b* and D4*b* that are respectively perpendicular to the outer wall surfaces. Accordingly, the axial fan assembly 100 therefore provides an upward airflow WU which combines the partial airflows in directions D3*a*, Dib and D4*b* and a downward airflow WD which combines the partial airflows in directions D4*a*, D1*a* and D3*b*, and the turbulences between the axial fan 1*a* and the axial fan 1*b* are reduced to a minimum.

Figure 5B:
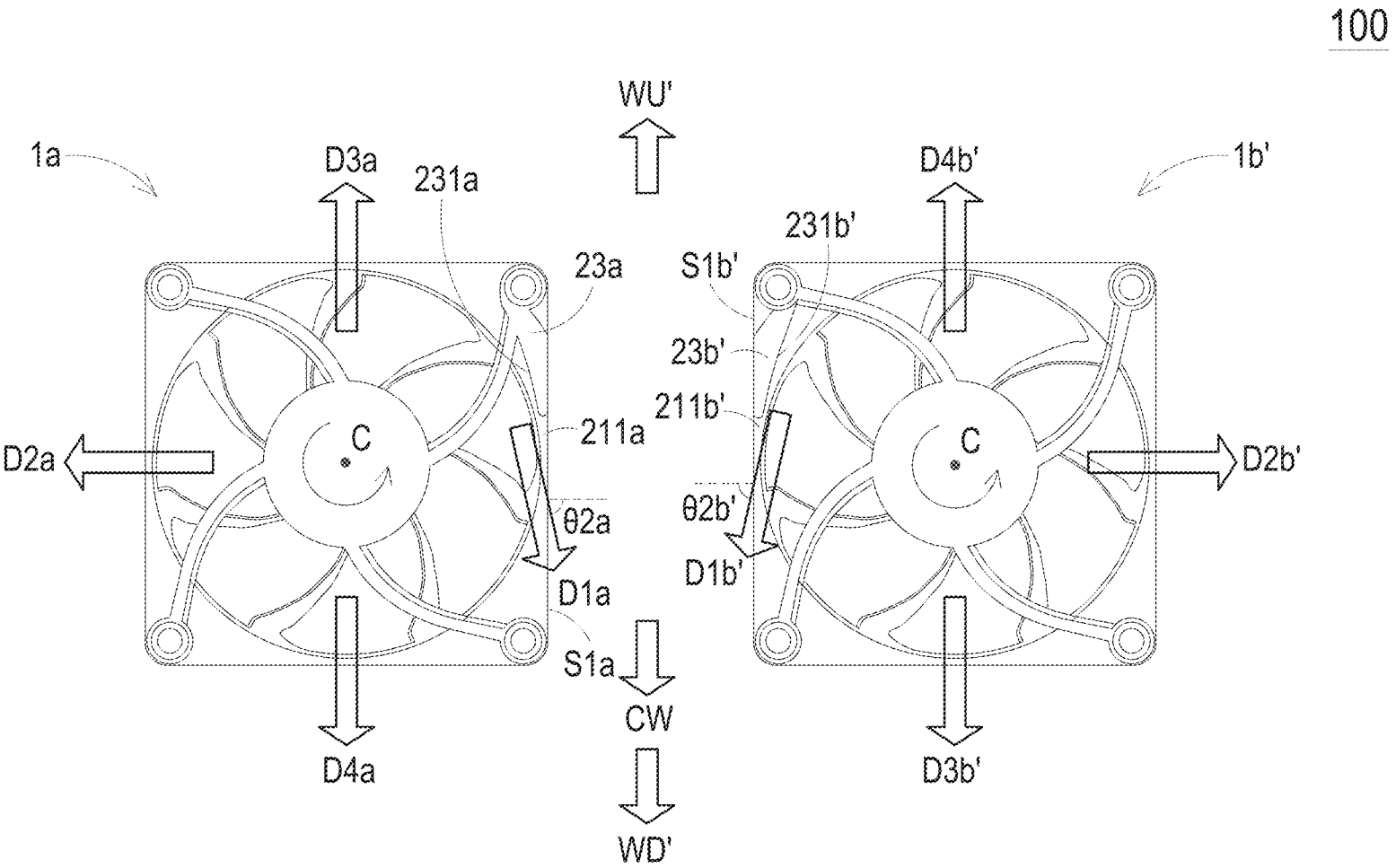
FIG. 5B is a schematic view showing an axial fan assembly according to another embodiment of the present disclosure.

FIG. 5B is a schematic view showing an axial fan assembly according to another embodiment of the present disclosure. In this embodiment, an axial fan assembly 100' includes an axil fan 1*a* and an axil fan 1*b*' which are adjacent to each other. The axial fan 1*a* and the axial fan 1*b*' face each other by employing an outer wall surface S1*a* and an outer wall surface S1*b*' respectively thereof, namely, are arranged side by side as shown in FIG. 5B. A lateral guiding structure 23*a* is disposed on an edge surface 211*a* that is connected with the outer wall surface S1*a*, a lateral guiding structure 23*b*' is disposed on an edge surface 211*b*' that is connected with the outer wall surface S1*b*', and the lateral guiding structure 23*a* and the lateral guiding structure 23*b*' are located at the adjacent ends of the adjacent outer wall surfaces S1*a* and S1*b*', that is, as shown in FIG. 5B, the lateral guiding structure 23*a* is located at the upper end related to the outer wall surface S1*a*, and the lateral guiding structure 23*b*' is located at the upper end related to the outer wall surface S1*b*'. Under this configuration, since both axial fans 1*a* and 1*b*' are rotated counterclockwise and the lateral guiding structure 23*a* is disposed at the upper right corner of the axial fan 1*a*, the partial airflow toward the outer wall surface S1*a* will be influenced by the first surface 231*a* (the windward surface) and changed toward the lower right direction Dia. On the other hand, since the lateral guiding structure 23*b*' is disposed at the upper left corner of the axial fan 1*b*', the partial airflow toward the outer wall surface S1*b*' will be influenced by the first surface 231*b*' (the windward surface) and changed toward a lower left direction D1*b*'. In this way, the original outflow directions that are toward each other at the junction of the two axial fans can be changed into substantially downward directions, so as to form a converged airflow CW with a downward converged direction. Then, it only needs to appropriately control the distance between the outer wall surface S1*a* of the axial fan 1*a* and the outer wall surface S1*b*' of the axial fan 1*b*' (e.g., the distance between the outer wall surfaces S1*a* and S1*b*' is negatively correlated with the included angles θ2*a* and θ2*b*'), and turbulences between axial fans and also noises can be effectively reduced, and the performance of the axial fan assembly can be improved.

Furthermore, the partial airflows in other three directions (except the one toward the outer wall surface S1*a*) of the axial fan 1*a* which are not influenced by the lateral guiding structure will remain directions D2*a*, D3*a* and D4*a* that are respectively perpendicular to the outer wall surfaces. Also, the partial airflows in other three directions (except the one toward the outer wall surface S1*b*') of the axial fan 1*b*' which are not influenced by the lateral guiding structure will remain directions D2*b*', D3*b*' and D4*b*' that are respectively perpendicular to the outer wall surfaces. Accordingly, the axial fan assembly 100' therefore provides an upward airflow WU' which combines the partial airflows in directions D3*a* and D4*b*' and a downward airflow WD' which combines the partial airflows in directions D4*a* and D3*b*' and the converged airflow CW, and the turbulences between the axial fan 1*a* and the axial fan 1*b*' are reduced to a minimum.

In other words, when the axial fans are arranged side by side in the assembly, it only needs to dispose the lateral guiding structures respectively adjacent to adjacent outer wall surfaces of adjacent axial fans, the respective airflows toward the adjacent outer wall surfaces can be effectively guided to change the directions thereof to be opposite to and staggered from each other or into airflows in substantially same directions, so as to reduce turbulences, and also, the axial fan assembly can provide outflows in all lateral directions.

Figure 6:
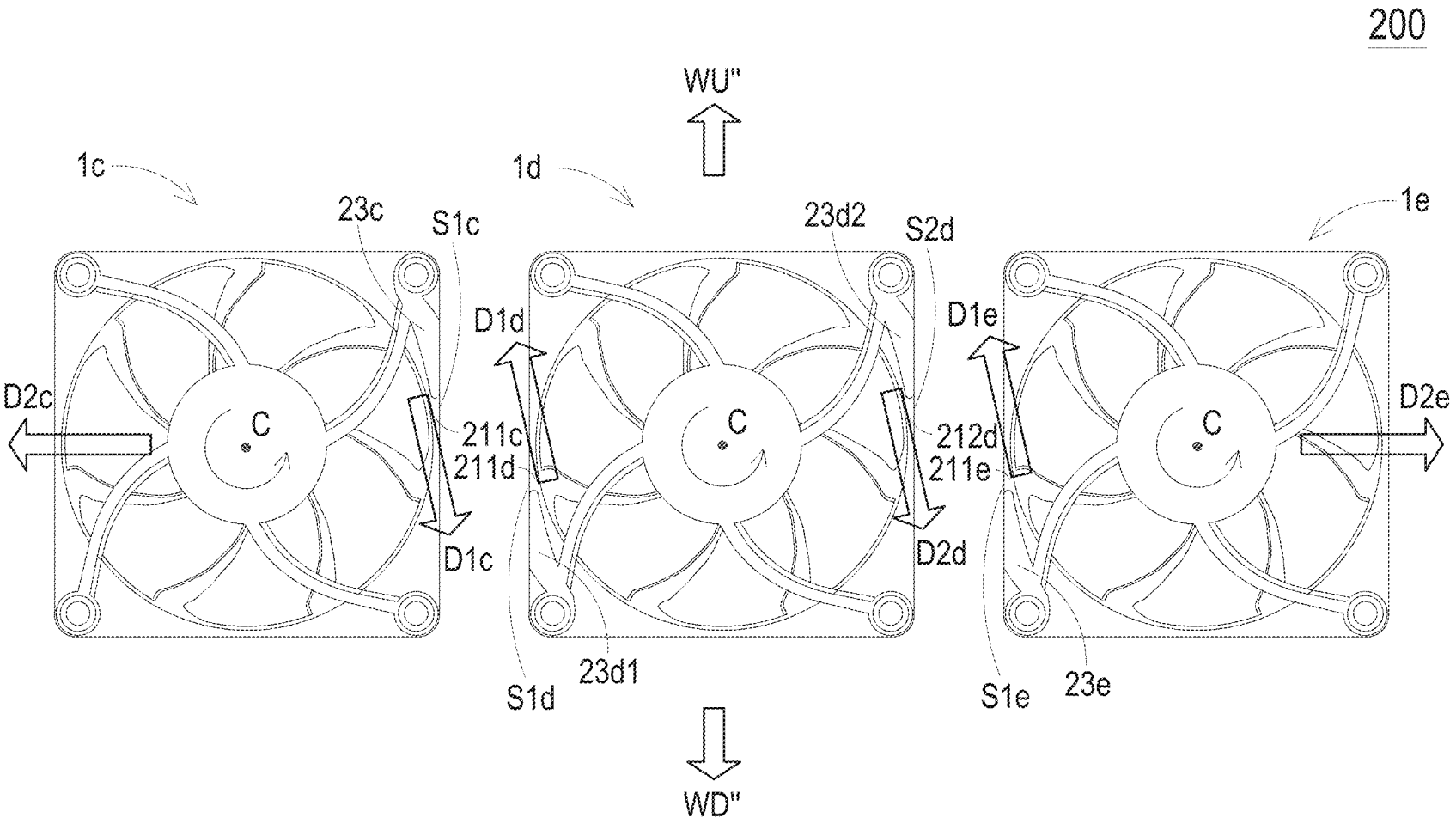
FIG. 6 is a schematic view showing an axial fan assembly according to another embodiment of the present disclosure.

FIG. 6 is a schematic view showing an axial fan assembly according to another embodiment of the present disclosure. An axial fan assembly 200 includes axial fans 1*c*, 1*d*, 1*e*, and each axial fan rotates counterclockwise. The axial fan 1*c* has a lateral guiding structure 23*c* disposed on an edge surface 211*c* that is connected with an outer wall surface Sic facing the axial fan 1*d*, the axial fan 1*d* has a lateral guiding structure 23*d*1 disposed on an edge surface 211*d* that is connected with an outer wall surface Sid facing the axial fan 1*c*, and a lateral guiding structure 23*d*2 disposed on an edge surface 212*d* that is connected with an outer wall surface S2*d* facing the axial fan 1*e*, and the axial fan 1*e* has a lateral guiding structure 23*e* disposed on an edge surface 211*e* that is connected with an outer wall surface S1*e* facing the axial fan 1*d*. The lateral guiding structure 23*c* and the lateral guiding structure 23*d*1 are respectively located at two opposite ends relative to the outer wall surface Sic and the outer wall surface Sid which are adjacent to each other, the lateral guiding structure 23*d*1 and the lateral guiding structure23*d*2 are located at diagonal positions of the axial fan 1*d*, and the lateral guiding structure 23*d*2 and the lateral guiding structure 23*e* are respectively located at two opposite ends relative to the outer wall surface S2*d* and the outer wall surface S1*e* which are adjacent to each other. Under this configuration, between the axial fan 1*c* and the axial fan 1*d*, airflows respectively toward directions D1*c* and D1*d*, which are opposite to and staggered form each other, are generated, and between the axial fan 1*d* and the axial fan 1*e*, airflows respectively toward directions D2*d* and Die, which are opposite to and staggered form each other, are generated. Accordingly, the axial fan assembly 200 therefore provides a combined upward airflow WU", a combined downward airflow WD", a leftward airflow mainly based on the partial airflow in direction D2*c* of the axial fan 1*c*, and a rightward airflow mainly based on the partial airflow in direction D2*e* of the axial fan 1*e*. Also, turbulences between the axial fan 1*c* and the axial fan 1*d* and between the axial fan 1*d* and the axial fan 1*e* are reduced to a minimum, and the axial fan assembly can provide outflows in all lateral directions.

Certainly, it also can be varied to locate lateral guiding structures at the adjacent ends relative to the adjacent outer wall surfaces of the adjacent axial fans, similar to FIG. 5B, so that the outflows between adjacent axial fans can be changed toward substantially downward directions. The structures and airflow directions thereof are similar and omitted.

In addition, other than arranged adjacently in one direction, when axial fans in an axial fan assembly are arranged in a matrix, through employing lateral guiding structures to dispose adjacent to the adjacent outer wall surfaces thereof, airflows opposite to and staggered from each other or converged airflows between adjacent axial fans also can be achieved so as to reduce turbulences and noises. The details of lateral guiding structures are similar and omitted.

In summary, in the present disclosure, through disposing the lateral guiding structure on the outlet end of the axial fan at a position adjacent to the outer wall surface of the surrounding wall, the original outflow in a direction perpendicular to the outer wall surface can be changed to include an acute angle with the normal direction of the outer wall surface, which facilitates an increasing of the outflow amount in a particular direction and the improvement of performance of the axial fan. Moreover, in the axial fan assembly, through disposing lateral guiding structures respectively on the outlet ends of adjacent axial fans adjacent to adjacent outer wall surfaces thereof, the respective outflows that are toward the adjacent outer wall surfaces and face each other can be effectively guided and changed to airflows opposite to and staggered from each other or a converged airflow, thereby reducing turbulences and noises between adjacent axial fans, and also improving the performance of the axial fan assembly.

While the disclosure has been described in terms of what is presently considered to be the most practical embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An axial fan assembly, comprising:

a first axial fan; and a second axial fan arranged side by side with the first axial fan, the second axial fan comprising:

a first impeller having a first shaft; and a first frame, comprising:

a first surrounding wall forming a first axial flow channel for accommodating the first impeller, wherein the first surrounding wall comprises a first outer wall surface facing the first axial fan, the first axial flow channel has a first outlet end, and a first airflow generated by the first impeller flows out of the first axial flow channel through the first outlet end; and a first lateral guiding structure protrudently disposed at the first outlet end on a first edge surface connected with the first outer wall surface, wherein the first lateral guiding structure is used to guide a first partial airflow of the first airflow at the first edge surface toward a first direction, and the first direction and a normal direction of the first outer wall surface include a first acute angle.

2. The axial fan assembly as claimed in claim 1, wherein the first axial fan comprises:

a second impeller having a second shaft; and a second frame, comprising:

a second surrounding wall forming a second axial flow channel for accommodating the second impeller, wherein the second surrounding wall comprises a second outer wall surface facing the second axial fan, the second axial flow channel has a second outlet end, and a second airflow generated by the second impeller flows out of the second axial flow channel through the second outlet end; and a second lateral guiding structure protrudently disposed at the second outlet end on a second edge surface connected with the second outer wall surface, wherein the second lateral guiding structure is used to guide a second partial airflow of the second airflow at the second edge surface toward a second direction, and the second direction and a normal direction of the second outer wall surface include a second acute angle.

3. The axial fan assembly as claimed in claim 2, wherein the first direction and the second direction are substantially opposite to and staggered from each other.

4. The axial fan assembly as claimed in claim 2, wherein the first partial airflow and the second partial airflow are converged to flow toward a first converged direction.

5. The axial fan assembly as claimed in claim 1, further comprising:

a third axial fan arranged side by side with the second axial fan at a third outer wall surface of the first surrounding wall, wherein the third outer wall surface faces the third axial fan; and a third lateral guiding structure protrudently disposed at the first outlet end on a third edge surface connected with the third outer wall surface, wherein the third lateral guiding structure is used to guide a third partial airflow of the first airflow at the third edge surface toward a third direction, and the third direction and a normal direction of the third outer wall surface include a third acute angle.

6. The axial fan assembly as claimed in claim 5, wherein the third axial fan comprises:

a third impeller having a third shaft; and a third frame, comprising:

a third surrounding wall forming a third axial flow channel for accommodating the third impeller, wherein the third surrounding wall comprises a fourth outer wall surface facing the second axial fan, the third axial flow channel has a third outlet end, and a fourth airflow generated by the third impeller flows out of the third axial flow channel through the third outlet end; and a fourth lateral guiding structure protrudently disposed at the third outlet end on a fourth edge surface connected with the fourth outer wall surface, wherein the fourth lateral guiding structure is used to guide a fourth partial airflow of the fourth airflow at the fourth edge surface toward a fourth direction, and the fourth direction and a normal direction of the fourth outer wall surface include a fourth acute angle.

7. The axial fan assembly as claimed in claim 6, wherein the third direction and the fourth direction are substantially opposite to and staggered from each other.

8. The axial fan assembly as claimed in claim 6, wherein the third partial airflow and the fourth partial airflow are converged to flow toward a second converged direction.

9. The axial fan assembly as claimed in claim 5, wherein the first lateral guiding structure and the third lateral guiding structure are directly connected.

10. The axial fan assembly as claimed in claim 5, wherein the first lateral guiding structure and the third lateral guiding structure are connected through a first connecting structure.

11. The axial fan assembly as claimed in claim 10, wherein the second axial fan is assembled with an external system or an external device through the first connecting structure.

12. The axial fan assembly as claimed in claim 1, wherein a distance between the first axial fan and the first outer wall surface is negatively correlated with the first acute angle.

13. The axial fan assembly as claimed in claim 1, wherein the first impeller comprises a plurality of blades, and the plurality of blades have wavy surfaces or flat surfaces.

14. An axial fan, comprising:

a first impeller having a first shaft; and a first frame, comprising:

a first surrounding wall forming a first axial flow channel for accommodating the first impeller, wherein the first surrounding wall comprises a first outer wall surface, the first axial flow channel has a first outlet end, and a first airflow generated by the first impeller flows out of the first axial flow channel through the first outlet end; and a first lateral guiding structure protrudently disposed at the first outlet end on a first edge surface connected with the first outer wall surface, wherein the first lateral guiding structure is used to guide a first partial airflow of the first airflow at the first edge surface toward a first direction, and the first direction and a normal direction of the first outer wall surface include a first acute angle.

15. The axial fan as claimed in claim 14, wherein the first frame comprises a second lateral guiding structure protrudently disposed at the first outlet end on a second edge surface connected with a second outer wall surface, wherein the second lateral guiding structure is used to guide a second partial airflow of the first airflow at the second edge surface toward a second direction, the second direction and a normal direction of the second outer wall surface include a second acute angle, and the first outer wall surface and the second outer wall surface are different outer wall surfaces of the first surrounding wall.

16. The axial fan as claimed in claim 15, wherein the normal direction of the first outer wall surface and the normal direction of the second outer wall surface are different.

17. The axial fan as claimed in claim 15, wherein a portion of a boundary of the first outer wall surface and a portion of a boundary of the second outer wall surface are directly connected and have an included angle.

18. The axial fan as claimed in claim 15, wherein a portion of a boundary of the first edge surface is directly connected with a portion of a boundary of the second edge surface.

19. The axial fan as claimed in claim 14, wherein the first impeller comprises a plurality of blades, and the plurality of blades have wavy surfaces or flat surfaces.

* * * * *